United States Patent [19]

Iten

[11] Patent Number: 4,706,385

[45] Date of Patent: Nov. 17, 1987

[54] ONE PIECE RAZOR BLADE HOLDER

[75] Inventor: Clemens A. Iten, Staunton, Va.

[73] Assignee: American Safety Razor Company, Verona, Va.

[21] Appl. No.: 834,521

[22] Filed: Feb. 28, 1986

[51] Int. Cl.[4] ..... B26B 29/00

[52] U.S. Cl. ..... 30/169; 30/286; 30/339

[58] Field of Search ..... 30/151, 162, 169, 286, 30/329, 330, 336, 337, 338, 339

[56] References Cited

U.S. PATENT DOCUMENTS

| | | | |
|---|---|---|---|
| 1,500,644 | 7/1924 | Scalbom . | |
| 2,119,045 | 5/1933 | Dietrich . | |
| 2,308,162 | 1/1943 | Frank . | |
| 2,507,019 | 5/1950 | Johnson | 30/337 X |
| 2,549,542 | 4/1951 | Stair . | |
| 2,596,303 | 5/1952 | Stead . | |
| 2,601,450 | 6/1952 | O'Neill . | |
| 2,610,354 | 9/1952 | Howell . | |
| 3,667,122 | 6/1972 | Black | 30/286 |
| 3,845,554 | 11/1974 | Joanis et al. | 30/339 X |
| 4,017,970 | 4/1977 | Williams . | |
| 4,182,033 | 1/1980 | Jacobson et al. . | |
| 4,189,829 | 2/1980 | Iten et al. | 30/169 X |
| 4,292,738 | 10/1981 | Osada | 30/339 X |
| 4,612,707 | 9/1986 | Shea . | |

*Primary Examiner*—E. R. Kazenske
*Assistant Examiner*—Michael D. Folkerts
*Attorney, Agent, or Firm*—Nixon & Vanderhye

[57] ABSTRACT

A one piece blade holder having a handle portion for serving as a hand grip when the holder is used as a razor blade scraping tool. A plurality of opposed, interdigitated finger members extend from the handle portion and operate to hold a blade having a cutting edge in either a cutting edge exposed or cutting edge protected position. A pivoted locking member is provided for engaging the blade in either of said positions, the locking member has means for releasably engaging the blade and is pivotable between a rest position in which the blade is engaged with a locking pin and a pivoted position in which the blade is released from engagement with the locking pin.

5 Claims, 5 Drawing Figures

ONE PIECE RAZOR BLADE HOLDER

BACKGROUND OF THE INVENTION

1. Field of the Invention

The present invention relates to a razor blade scraper and more particularly to a scraper which uses a single edge safety razor blade and which includes a novel, one piece, rugged plastic holder operable for safely storing the blade in a blade-protected position and for securely holding the blade in a blade-exposed position for scraping.

2. Background of the Invention

Holders for single edge safety razor blades are well-known. For example, U.S. Pat. No. 2,599,542 describes a blade holder in which such a blade may be locked in an exposed or operative position. U.S. Pat. No. 1,500,644 describes a blade holder for a double edge blade having a member for covering an exposed cutting edge. U.S. Pat. No. 2,119,045 describes a blade holder in which the blade is supported in a holder between a pair of jaw plates, the holder being operable to be inserted into a frame with the blade in either an exposed or protected position. U.S. Pat. No. 2,308,162 describes a scraper for use with double or single edge blades in which the blade holder is retractable into a carrying handle. U.S. Pat. No. 2,596,303 describes a pocket knife in which a razor blade is held in either a retracted or cutting position. U.S. Pat. No. 2,610,314 describes a handle for releasably securing a razor blade by means of clamp-like sections.

These prior art blade holders are either expensive to manufacture, requiring separate elements such as springs, handles, holders, locking and fastening elements, etc., are relatively clumsy to use in terms of changing the blade, or do not securely and positively engage the blade for fail safe operation.

SUMMARY OF THE INVENTION

It is therefore an object of the present invention to provide an economical and safe blade holder and scraper.

It is a further object of the invention to provide a single piece blade holder for safely and securely holding a standard single-edged safety razor blade in either a blade exposed or blade protected position.

To achieve the foregoing and other objects and in accordance with the purpose of the present invention as embodied and broadly described herein, a one piece blade holder/scraper is provided which is preferably molded from plastic, and comprises a handle portion which serves as the gripping portion of the holder for facilitating use as a cutter or scraper. A plurality of opposed, interdigitated finger members extend from the handle. The finger members are operable to hold a blade, such as a standard single edge safety razor blade, in either a blade exposed or blade protected position. A pivoting locking member, integrally formed with the handle is also provided. The locking member operates to engage the blade in either of the above-described positions and preferably includes a pin for positively engaging an opening in the blade.

A blade holder thus formed is inexpensive and light yet durable, sturdy and comfortable to use. The positive engagement locking pin assures safe blade storage and use and the operating member of the pivoting locking member formed in a recess in the handle and is thus easy and comfortable to use.

BRIEF DESCRIPTION OF THE DRAWINGS

The accompanying drawings, which are incorporated in and form a part of the specification, illustrate the presently preferred embodiment of the invention and together with the description serve to explain the principles of the invention. In the drawings.

DETAILED DESCRIPTION OF THE INVENTION

Figure 1:
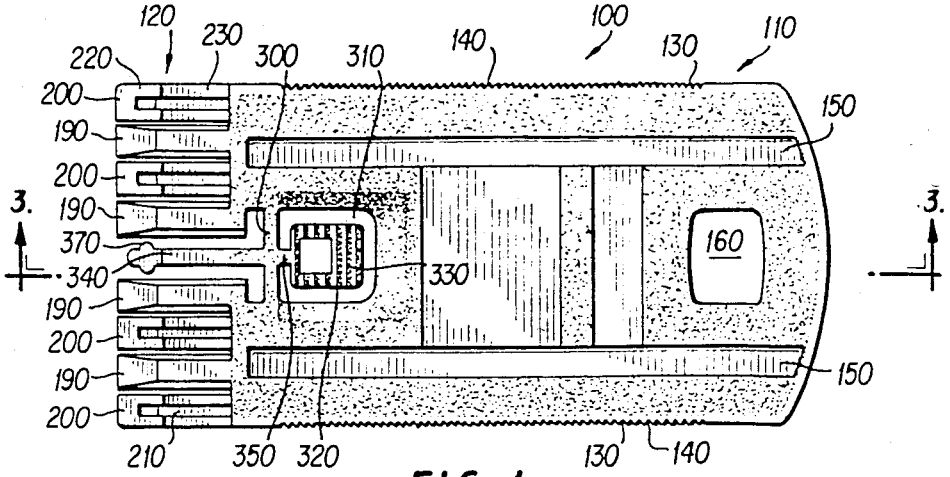
FIG. 1 is a top view of a blade holder according to the present invention.

Reference will now be made to the presently-preferred embodiment of the invention, an example of which is illustrated in the accompanying drawings. Turning first to FIG. 1, there is illusrated a razor blade holder according to the present invention, generally denoted by the numeral 100. The blade holder is particularly useful for use in holding a standard single edge blade for use as a scraping tool. Preferably, the entire blade holder is of a single piece construction and formed from molded polypropylene. The blade holder 100 includes a handle portion 110 and a blade engaging portion 120. The sides 130 of the handle portion are preferably provided with a knurled or rib design 140 to assist the user in gripping the blade holder. A pair of longitudinal ribs 150 preferably extend along the blade holder in order to add strength and rigidity to the structure. Preferably, an opening 160 is formed in the handle to serve as a convenient opening for engaging a hook member or the like on which the blade holder may be stored when not in use.

Figure 4:
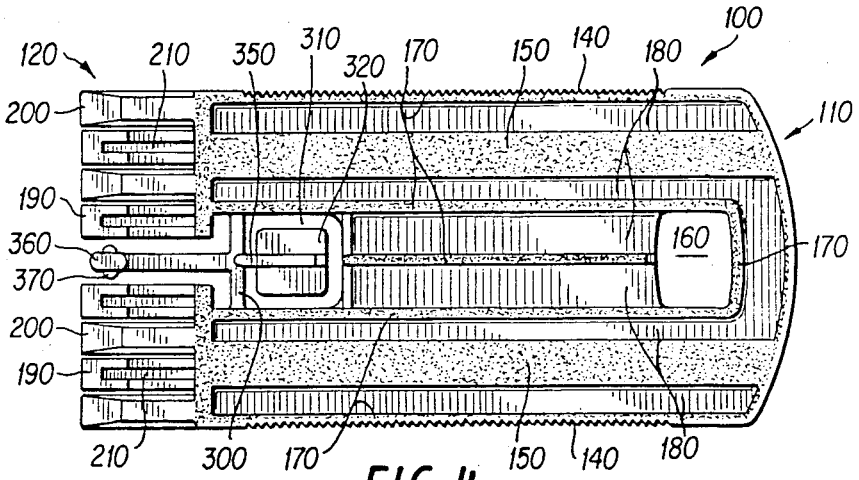
FIG. 4 is a bottom view of the blade holder of FIG. 1.
Figure 2:
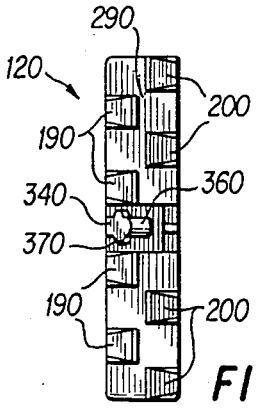
FIG. 2 is a sectional view, through section lines 2—2 of FIG. 1.

The bottom side of the blade holder, best viewed in FIG. 4, may also be provided with a series of strengthening ribs 170 which define a plurality of channels 180 running generally longitudinally along the bottom side of the handle portion in order to add strength and rigidity to the handle and to eliminate unnecessary material from the handle which adds to economy of production and lightness of weight.

Turning now to the blade engaging portion 120 of the blade holder, there are provided a plurality of upper blade holding fingers interdigited with a series of lower blade holding fingers 200. While in the preferred embodiment, there are four upper blade holding fingers 190 and four lower blade holding fingers 200, it will be appreciated by the artisan that the invention is not restricted to any precise number of blade holding fingers.

The fingers 190 and 200 are preferably integrally formed with the handle portion 110 during the molding process.

Preferably, a rib or channel 210 is provided in each of the blade holding fingers 190 and 200.

Each of the blade holding fingers comprises two portions, an end portion 220 and a root portion 230. The end portion 220 comprises a raised pad which functions to support the cutting blade. The slightly recessed root portions 230 provide a key way 200 for accepting the ribbed portion of a standard single edge safety razor blade, such as that depicted in FIG. 5.

Figure 5:
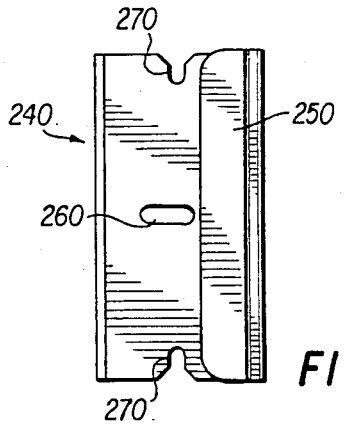
FIG. 5 is a plan view of a safety razor blade of the type which may be used with the present invention.

Turning briefly to FIG. 5, there is depicted a standard single edge safety razor blade 240 having a back rib 250, an opening 260 disposed approximately in the center of the blade and a pair of cutouts 270 disposed along the side edges of the blade. As will be appreciated by the artisan, the back rib 250 strengthens the blade and comprises a thickness several times greater than the thickness of the blade itself.

Figure 3:
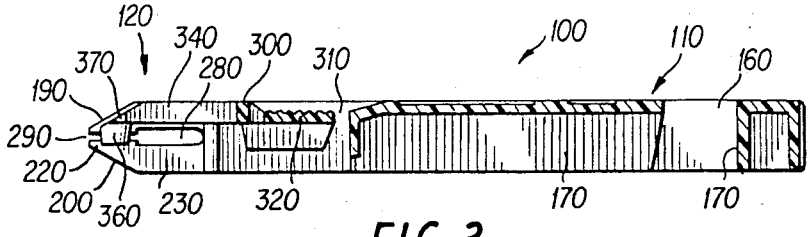
FIG. 3 is a sectional view, through section lines 3—3 of FIG. 1.

The key way 280 formed by the opposing recesses 230 of the upper and lower holding fingers 190 and 200 respectively, is best seen in FIG. 3 and is sized to accomodate the thickness of the back rib 250. Also best seen in FIG. 3, is a gap 290 which is defined by the surfaces of the pads 220 of the interdigited upper and lower holding fingers 190 and 200 respectively. The gap 290 is preferably sized to snugly hold the blade of a standard single edge safety razor. It will also be appreciated by the artisan, that the plane of a safety razor, when inserted into the holder, is coincident with the gap 290.

The structure and functioning of the pivoting locking member will now be described. Integrally formed with the handle portion 110 is a fulcrum 300 which preferably comprises a bar member extending between two central strengthening ribs 170. The handle 110 is provided with an opening 310 in which there is disposed a finger pad 320 preferably having a narrowed or ribbed upper surface 330 which is either flush with or preferably slightly recessed from the upper surface of the handle 110. The finger pad 320 is preferably connected to a locking member 340 through a neck portion 350. The end of the locking member 340 is provided with a key or pin 360 which is dimensioned and positioned to cooperate with the opening 260 in a standard razor blade. Preferably, the key or pin 360 is provided with stop members 370 which limit the lateral movement of the pin 360 and therefore the lateral movement of the blade.

In operation, when it is desired to insert a safety blade, the finger pad 320 is depressed, causing the locking member 340 to pivot about the fulcrum 300 thereby moving the key or pin 360 out of the gap 290. This permits insertion of a razor blade in either a blade exposed position, with the cutting edge of the blade pointing away from the blade holder, or in the blade protected position with the cutting edge of the razor blade safely encased in the key way 280.

In either position, the key or pin 360 cooperates with the opening 260 in the razor blade in order to securely lock the razor blade in place.

It should be appreciated, that when inserting a razor blade in the cutting edge exposed position, it must inserted from the side by sliding the ribbed portion 250 of the razor blade into the key way 280 provided in the blade engaging portion 120 of the blade holder.

As soon as the finger pad is released, it will pivot back into its rest position, with the pin 360 engaging the hole 260 in the razor blade to prevent inadvertent slippage or accidental removal of the blade.

The foregoing description of a preferred embodiment of the invention has been presented for purposes of illustration and description. It is not intended to be exhaustive or to limit the invention to the precise form disclosed, and obviously many modifications and variations are possible in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A one-piece blade holder comprising:

a handle portion;

a plurality of opposed, interdigitated finger member means, integrally formed with and extending from said handle portion, for holding a blade having a cutting edge in either one of a cutting edge exposed or a cutting edge protected position;

a pivotable locking member, integrally formed with said handle portion and, having means for engaging said blade in either of said positions, said locking member having means for releasably engaging said blade and being pivotable between a rest position in which said blade is engaged by said locking member and a pivoted position in which said blade is released from engagement with said locking member, a fulcrum integrally formed in said handle; and a finger actuated lever means, integrally formed in said handle, for pivoting said locking member; wherein said locking member pivots about said fulcrum and wherein said finger actuated lever means for pivoting said locking member is disposed in a recess in said handle portion.

2. The blade holder of claim 1 wherein said holder is integrally formed of molded plastic.

3. The blade holder of claim 1 wherein said blade further has a spine portion and said finger members have an end portion, the end portions of opposing fingers forming a gap for supporting said blade, and a root portion, the root portions of opposing fingers forming a key way for accomodating passage of said spine portion.

4. The blade holder of claim 1 wherein said means for engaging comprises a locking pin, operable to cooperate with an opening in said blade, for securely locking said blade.

5. The blade holder of claim 4 further comprising stop means associated with said locking pin for limiting lateral movement of said blade when said locking member is in said rest position.

* * * * *